US006358318B1

(12) United States Patent
Gherardi et al.

(10) Patent No.: US 6,358,318 B1
(45) Date of Patent: Mar. 19, 2002

(54) GUMMING DEVICE

(75) Inventors: Gian Luigi Gherardi; Fiorenzo Draghetti, both of Medicina (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 09/331,097

(22) PCT Filed: Oct. 13, 1998

(86) PCT No.: PCT/IB98/01608

§ 371 Date: Jun. 10, 1999

§ 102(e) Date: Jun. 10, 1999

(87) PCT Pub. No.: WO99/19077

PCT Pub. Date: Apr. 22, 1999

(30) Foreign Application Priority Data

Oct. 14, 1997 (IT) ..... BO97A0610

(51) Int. Cl.[7] ..... B05C 1/08

(52) U.S. Cl. ..... 118/261; 118/262; 118/304; 156/578

(58) Field of Search ..... 118/261, 262, 118/304; 156/578; 427/207.1, 428

(56) References Cited

U.S. PATENT DOCUMENTS

| | | | | |
|---|---|---|---|---|
| 2,981,226 A | | 4/1961 | Murray | |
| 3,417,693 A | | 12/1968 | Hartka | |
| 3,540,410 A | | 11/1970 | Osborne, Jr. et al. | |
| 5,667,589 A | | 9/1997 | Mailander | |
| 5,755,883 A | * | 5/1998 | Kinose et al. | 118/261 |

FOREIGN PATENT DOCUMENTS

| | | |
|---|---|---|
| DE | 537 165 | 11/1931 |
| DE | 295 13 970 U | 11/1995 |
| DE | 195 18 132 | 2/1997 |
| FR | 1 135 284 | 4/1957 |
| GB | 772182 | 4/1957 |
| GB | 911 261 | 11/1962 |
| GB | 2 067 436 | 7/1981 |

OTHER PUBLICATIONS

DE–U–295 13 970, see abstract attached.
DE–C–537 165, see abstract attached.
FR–A–1 135 284, see abstract attached.
DE–C–195 18 132, see abstract attached.

* cited by examiner

*Primary Examiner*—Laura Edwards
(74) *Attorney, Agent, or Firm*—The Law Offices of Timothy J. Klima

(57) ABSTRACT

A gumming device includes a first and a second roller, with horizontal, parallel axes, in contact with each other at a zone of tangency along a common generating line, defining a space between respective cylindrical surfaces just above the zone of tangency. A device for feeding an adhesive substance into the space includes an adhesive distributing element having an end portion located between the rollers at the space over the zone of tangency and having at least one downflow wall for conveying an essentially laminar, continuous flow of adhesive substance to said space.

10 Claims, 1 Drawing Sheet

1
2
2
3
4
5
6
7
8
9
10
11
12
13
14
15
16
17
18
19
20
21
22
23
24
25
26
27
27a
28
29
30
31
32
33
34
35
36
37
38
39
40
41
41
42
S
D
G
V 2
3
5
7
9
23
25
27
29
35
37
39
D
G

GUMMING DEVICE

This application is the national phase of international application PCT/IB98/01608 filed Oct. 13, 1998 which designated the U.S.

TECHNICAL FIELD

The present invention relates to a gumming device. The invention can be used to good advantage to apply an adhesive substance to lengths of paper tape in machines for the tobacco industry to which the description below refers but without thereby restricting the scope of the invention.

In particular, the invention relates to a gumming roller device used in a cigarette filter tip attaching machine to apply a layer of adhesive substance to a continuous paper tape that is subsequently cut into individual lengths or strips to be used to attach the filter tips to cigarettes.

BACKGROUND ART

A gumming device used to apply a layer of adhesive to a continuous paper tape from which the connecting strips of filter paper for a cigarette filter tip attaching machine are cut is disclosed by United Kingdom patent No. 2,067,436, this gumming device comprising a pair of horizontal, counter-rotating rollers, placed side by side and elastically pressed against each other along a zone of reciprocal tangency. One of the two rollers is a dosing roller and the other a gumming roller whose surface, being essentially cylindrical, is tangent to the continuous tape.

The facing portions of the two cylindrical surfaces, just above the zone of tangency between the dosing roller and the gumming roller, define a space above which there is located a nozzle connected to the outfeed end of a pipe from a tank containing an adhesive substance.

The adhesive accumulates inside the said space, which extends along the entire contact generator between the two rollers, so as to constantly supply the gumming roller. While the gumming roller rotates in a defined direction, its outer cylindrical surface transfers a layer of adhesive to the continuous paper tape, the thickness of the layer being adjusted by the pressure between the two rollers.

Practice has shown that a gumming device of the type described cannot cope with the high operating speeds reached by the latest generation, of cigarette makers, causing the two rollers to turn at very high speeds, because it is unable to correctly transfer a layer of adhesive onto the surface of the of the continuous paper tape to be gummed. This is because the mass of adhesive substance inside the said space is subjected to a high-speed wave-like motion by the cylindrical surfaces of the two rollers, giving rise to strong turbulence with high pressure gradients within the mass of adhesive. This turbulence traps air inside the adhesive creating bubbles and causing the adhesive to splash when the air bubbles burst. Moreover, when the air bubbles come into contact with the cylindrical surface of the gumming roller, they prevent the adhesive from being properly distributed on the surface and creating breaks and uneven patches in the layer of adhesive transferred by the gumming roller.

As a result, parts of the surface of the continuous paper tape to be gummed have no adhesive on them at all.

DISCLOSURE OF THE INVENTION

The aim of the present invention is to provide a gumming device that overcomes the above mentioned disadvantages.

Accordingly, the present invention provides a gumming device comprising a first and a second roller, with horizontal, parallel axes, in contact with each other at a zone of tangency along a common generator, defining a space between the respective cylindrical surfaces just above the zone of tangency; and means for feeding an adhesive substance into the space, the device being characterized in that the adhesive feed means comprise means designed to distribute the adhesive located and shaped in such a way, in relation to the rollers, as to partially occupy the space.

The invention will now be described with reference to the accompanying drawings which illustrate two preferred embodiments of the invention and in which.

Figure 1:
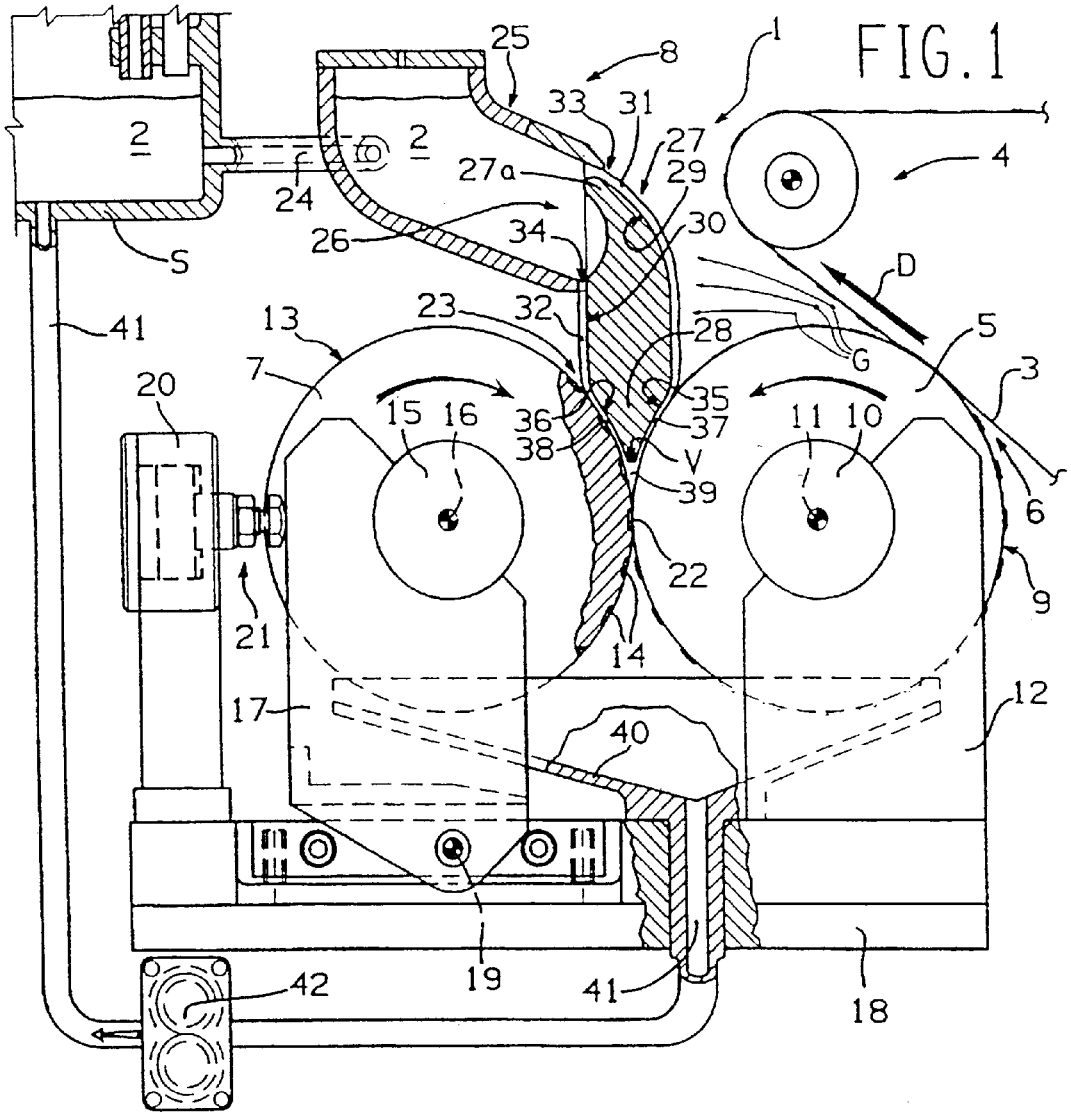
FIG. 1 is a front view, partly in cross section and with some parts cut away in order to better illustrate others of a preferred embodiment of the gumming device made according to the present invention.

With reference to FIG. 1, the numeral 4 indicates a cigarette filter tip attaching machine illustrated only partially and the numeral 1 indicates as a whole a gumming device used to apply an adhesive substance 2 to a continuous paper tape 3 which moves forward in a feed direction D and which is cut into individual lengths (not illustrated) used to attach filter tips (not illustrated) to cigarettes (not illustrated).

The device 1 comprises a first, gumming roller 5 designed to apply a layer of adhesive substance 2 to the tape 3 at a gumming station 6, a second, dosing roller 7 designed to operate in conjunction with the gumming roller 5 to dose the quantity of adhesive 2 to be applied to the tape 3 and a unit 8 for the continuous feeding of the adhesive 2 to the two rollers 5 and 7.

The gumming roller 5 has a cylindrical lateral surface 9, which is tangent to the tape 3 at a gumming station 6, and is keyed to a shaft 10 with a horizontal axis 11. The shaft 10 is driven by a motor (not illustrated) and rotates the roller 5 about the axis 11, in a counterclockwise direction in FIG. 1, relative to a fixed fork 12 which supports the shaft 10 itself.

The dosing roller 7 has an essentially cylindrical outer surface, with recessed areas or pockets 14, and is keyed to a central shaft 15 whose axis 16 is essentially horizontal and parallel to the axis 11 with which the axis 16 makes an essentially horizontal plane.

As shown in FIG. 1, the shaft 15, which is driven by the shaft 10 through transmission means that are not illustrated, rotates the roller 7 about the axis 16 at a peripheral speed equal to that of the roller 5 and is supported by a fork 17 in such a way that it can rotate. The side of the fork 17 opposite that which supports the shaft 15 is hinged to a fixed frame 18 in such a way that it can swing in relation to the frame 18 itself about an axis 19 parallel to the axes 11 and 16, under the action of an actuator 20.

The actuator 20 and the fork 17 together form a pushing device designed to move the dosing roller 7 closer to the gumming roller 5 so that their respective outer surfaces 9 and 13 come into contact with each other at a zone 22 of tangency along a common generator, parallel to the axes 11 and 16, thus defining a space 23 between the zone 22 of tangency and the parts of the surfaces 9 and 13 upstream of the zone 22 of tangency in relation to the sense of rotation of the rollers 5 and 7.

As shown in FIG. 1, the feed unit 8 comprises a tank S containing the adhesive 2 and having an outfeed pipe 24 which communicates with an essentially funnel-shaped receptacle 25 in which the adhesive 2 collects and having an outlet 26 at which there is located a distributor element 27 whose longitudinal dimension, measured in a direction parallel to the axes 11 and 16 of the rollers 5 and 7, is substantially the same as the longitudinal dimension of the rollers 5 and 7.

As illustrated in FIG. 1, the distributor element 27 has a head 27*a*, which joins the aforesaid outlet 26 of the receptacle 25 in such a way as to leave two lateral gaps or slits 33 and 34 for the outflow of the adhesive 2, an end portion 28, located and shaped in such a way as to partially occupy the aforementioned space 23, and two opposing lateral walls 29 and 30 that connect the head 27*a* to the end portion 28. The two lateral walls 29 and 30 form in the distributor 27 two adhesive 2 downflow surfaces 29 and 30 which hydrodynamically and uninterruptedly connect the two lateral outflow gaps 33 and 34 to the aforementioned end portion 28, which, in the embodiment illustrated in FIG. 1, is essentially cusp-shaped with a rounded vertex V located in the proximity of, and facing, the aforesaid zone 22 of tangency between the rollers 5 and 7.

As shown in FIG. 1, the end portion 28 is laterally defined by two essentially cylindrical lateral surfaces 35 and 36, which are essentially coaxial with the rollers 5 and 7 and which meet at the vertex V. The surfaces 35 and 36, together with the surfaces 9 and 13 of the rollers 5 and 7, form two arched channels 37 and 38, which connect with the downflow surfaces 29 and 30 and form two channels that feed the adhesive 2 to the zone 22 of tangency between the two rollers 5 and 7.

Again with reference to the sense of rotation of the rollers 5 and 7, as shown in FIG. 1, the gumming device 1 comprises, in the area below the zone 22 of tangency between the two rollers 5 and 7, a recycling vessel 40 which communicates with a pipe 41 through which the adhesive 2 that collects in the vessel 40 is pumped back into the tank S by a pump 42.

During operation, before the tape 3 starts being gummed, the device 21 is activated so as to elastically press the rollers 5 and 7 against each other, with their surfaces 9 and 13 in contact at the aforesaid zone 22 of tangency along a common generator.

After this, the adhesive 2 feed unit 8 is activated and the adhesive starts flowing out through the pipe 24 and collects in the receptacle 25. In particular, the adhesive 2 is fed at a rate such as to keep the level in the receptacle 25 constant.

Thus, the adhesive 2 flows with constant motion towards the outlet 26 and through the outflow slits 33 and 34 to reach the distributor element 27 on whose downflow surfaces 29 and 30 there are formed essentially laminar flows 31 and 32 of adhesive 2, respectively. The flows 31 and 32 move by gravity until they arrive at the channels 37 and 36, along which the flows 31 and 32 run essentially tangent to the respective surfaces 9 and 13 of the rollers 5 and 7 and reach a zone of confluence 39 between the surfaces 9 and 13, limited, at the top, by the vertex V of the element 27 and, at the bottom, by the zone 22 of tangency between the rollers 5 and 7.

The adhesive is free to flow out of the zone of confluence 39, which is open at both the longitudinal ends, and drops into the vessel 40.

As the laminar flows 31 and 32 pass through the channels 37 and 38, the adhesive 2 adheres to the surfaces 9 and 13 of the rollers 5 and 7 and, following the rotation of the rollers 5 and 7, is drawn towards the zone of tangency 22 and out of the space 23.

As it continues to rotate, the gumming roller 5 transfers the adhesive 2 picked up in this way to the station 6 where a layer of the adhesive 2 is applied to the tape 3.

The thickness of the adhesive 2 that adheres to the roller 5 depends on the pressure with which the dosing roller 7 is pressed against the gumming roller 5 and, in particular, only the quantity of the adhesive 2 that flows inside the pockets 14 of the roller 7 is allowed to flow out of the space 23.

It should be noticed that, during the operation of the device 1, the particles or droplets G of adhesive 2 which inevitably drop off the roller 5 just downstream of the station 6, in relation to the feeding of the tape 3 in the direction D, and which are the parts of the adhesive 2 which have not adhered to the tape 3, are intercepted by the wall 29 on which the flow 31 runs, thus preventing the droplets G from being splashed onto parts of the filter tip attaching machine 4.

Figure 2:
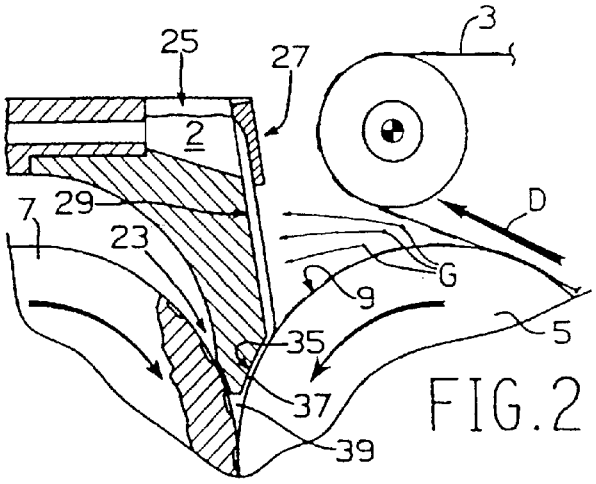
FIG. 2 is a front view, partly in cross section and with some parts cut away in order to better illustrate others of another preferred embodiment of the gumming device illustrated in FIG. 1.

In the embodiment illustrated in FIG. 2, the downflow section of the element 27 is only the wall 29 while its portion 35 is coupled with the surface 9 of the gumming roller 5 to form the channel 37, and it is along the latter that, during operation, the adhesive 2 adheres to the surface 9 of the gumming roller 5.

From the above description, it appears that the distributor means 25, 27, and, in particular, the presence of the portion 28 within the space 23, make it possible to prevent turbulence in the adhesive which, as stated above, in the devices known to prior art, prevent the adhesive from being applied correctly to the tape 3.

We claim:

1. A gumming device including a first and a second roller (5, 7), with horizontal, parallel axes (11, 16), in contact with each other at a zone (22) of tangency along a common generating line, defining a space (23) between respective cylindrical surfaces (9, 13) just above the zone (22) of tangency; means (8) for feeding an adhesive substance (2) into the space (23), said adhesive feed means (8) comprising means (25, 27) for distributing the adhesive (2) having an end portion (28) located between the rollers (5, 7) at the space (23) over the zone (22) of tangency and having at least one downflow wall (29,30) for conveying an essentially laminar, continuous flow of adhesive substance (2) to said space (23).

2. The device according to claim 1 wherein the end portion (28) is laterally defined by at least one essentially arcuate surface (35, 36), said arcuate surface being essentially coaxial with one of the two rollers (5, 7) and, together with the surface (9, 13) of the roller (5, 7), defining a channel (37; 38) that feeds the adhesive (2) to the zone (22) of tangency between the two rollers (5, 7).

3. The device according to claim 2 wherein the distributor means (25, 27) comprise an essentially funnel-shaped receptacle (25) in which the adhesive (2) collects and connected to an element (27) that distributes the adhesive (2) itself, a tapered end portion (28) of said distributor means (27) being located in the space (23) and being in cross section essentially in the shape of a cusp with a rounded vertex (V) facing the zone (22) of tangency between the two rollers (5,7); said distributor means (27) having first and second downflow walls (29, 30) opposite each other; the first wall (29) having, at the end portion (28), a portion (35) that is essentially adjacent to the surface (9) of the first roller (5) and the second wall (30) having a portion (36) that is essentially adjacent to the surface (13) of the second roller (7); the adhesive (2) flowing down at least one of the first and second walls (29, 30) according to a flow (31, 32).

4. The device according to claim 3 wherein the portions (35, 36) are parts of cylindrical surfaces which meet at the vertex (V) and are coupled, respectively, with the surface (9) of the first roller (5) and with the surface (13) of the second roller (7) in such a way as to form with the surfaces (9, 13) themselves a first curved channel (37) and a second curved channel (38), at least one of the first and second channels (37, 38) being crossed by an essentially laminar flow (31, 32) of adhesive (2).

5. The device according to claim 3 comprising a gumming station (6) including the roller (5) which is a gumming roller, a continuous tape of paper (3) feeding in a direction (D) and positioned tangent to said gumming roller at the gumming station (6) for applying the adhesive (2) to the tape (3), wherein the first wall (29) of the distributor means (27) is disposed just downstream of the gumming station (6) or intercepting droplets (G) of adhesive (2) that drop off the gumming roller (5) just downstream of the gumming station (6) in the feed direction (D) of the tape (3).

6. The device according to claim 1 wherein the end portion (28) is laterally defined by essentially arcuate surfaces (35, 36), said arcuate surfaces being essentially coaxial with the respective rollers (5, 7) and, together with the surfaces (9, 13) of the rollers (5, 7), defining two channels (37, 38) that feed the adhesive (2) to the zone (22) of tangency between the two rollers (5, 7).

7. The device according to claim 6 wherein the means (25, 27) for distributing the adhesive (2) are defined, above the end portion (28), by downflow walls (29, 30) connected at the bottom to the channels (37, 38) for conveying essentially laminar, continuous lows of adhesive (2) from a tank (S) to the respective channels (37, 38) themselves.

8. The device according to claim 1 comprising a gumming station (6) including the roller (5) which is a gumming roller, a continuous tape of paper (3) feeding in a direction (D) and positioned tangent to said gumming roller at the gumming station (6) for applying the adhesive (2) to the tape (3); the second roller (7) being a dosing roller (7) for dosing a quantity of adhesive (2) on the gumming roller (5).

9. A gumming device comprising a first and a second roller, with horizontal, parallel axes, in contact with each other at a zone of tangency along a common generating line, defining a space between respective cylindrical surfaces just above the zone of tangency; means for feeding an adhesive substance into the space, said adhesive feed means including means for distributing the adhesive having an end portion between the rollers in the space, the end portion being laterally defined by at least one essentially arcuate surface, said arcuate surface being essentially coaxial with one of the two rollers and, together with the surface of the roller defining channels that feed the adhesive to the zone of tangency between the two rollers, wherein the means for distributing the adhesive are defined, above the end portion, by downflow walls connected at the bottom to the channels for conveying essentially laminar, continuous flows of adhesive from a tank to the respective channels themselves.

10. A gumming device comprising a first and a second roller, with horizontal, parallel axes, in contact with each other at a zone of tangency along a common generating line, defining a space between respective cylindrical surfaces just above the zone of tangency; means for feeding an adhesive substance into the space, said adhesive feed means including means for distributing the adhesive positioned in relation to the rollers to partially occupy the space, wherein the distributor means comprise an essentially funnel-shaped receptacle in which the adhesive collects and connected to an element that distributes the adhesive itself; a tapered end portion of said distributor means being located in the space and being in cross section essentially in the shape of a cusp with a rounded vertex facing the zone of tangency between the two rollers said distributor means having first and second downflow walls opposite each other; the first wall having, at the end portion, a portion that is essentially adjacent to the surface of the first roller and the second wall having a portion that is essentially adjacent to the surface of the second roller; the adhesive flowing down at least one of the first and second walls according to a laminar flow.

* * * * *